US012302969B2

(12) United States Patent
Blakely

(10) Patent No.: US 12,302,969 B2
(45) **Date of Patent: *May 20, 2025**

(54) ARTICLE OF APPAREL

(71) Applicant: Under Armour, Inc., Baltimore, MD (US)

(72) Inventor: Kyle S. Blakely, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/409,996

(22) Filed: Jan. 11, 2024

(65) Prior Publication Data

US 2024/0306747 A1 Sep. 19, 2024

Related U.S. Application Data

(63) Continuation of application No. 17/589,305, filed on Jan. 31, 2022, now Pat. No. 11,871,806, which is a (Continued)

(51) Int. Cl.
*A41D 13/00* (2006.01)
*A41D 1/04* (2006.01)
*A41D 31/18* (2019.01)

(52) U.S. Cl.
CPC ..... *A41D 31/185* (2019.02); *A41D 1/04* (2013.01); *A41D 13/0015* (2013.01)

(58) Field of Classification Search
CPC ..... A41D 13/0015; A41D 13/02; A41D 1/06; A41D 1/04; A41D 13/015; A41B 1/00; A63B 21/0552
See application file for complete search history.

(56) References Cited

U.S. PATENT DOCUMENTS 5,606,745 A 3/1997 Gray
5,807,368 A 9/1998 Helmer
(Continued)

FOREIGN PATENT DOCUMENTS

EP 1980165 10/2008
GB 2579602 A * 7/2020 ..... A41D 1/08
(Continued)

OTHER PUBLICATIONS

International Search Report and Written Opinion in PCT/US2015/011437, mailed May 28, 2015.

*Primary Examiner* — Tajash D Patel
(74) *Attorney, Agent, or Firm* — Maginot, Moore & Beck, LLP

(57) ABSTRACT

An article of apparel includes a plurality of textile panels and a textile material. The plurality of textile panels includes a first textile panel and a second textile panel. The first textile panel is spaced apart from the second textile panel to define a gap between the first textile panel and the second textile panel on the article of apparel. Each of the plurality of textile panels possesses an elongation value and includes a plurality of reinforcing ribs extending across said textile panel. The textile material is positioned in the gap between the first textile panel and the second textile panel. The textile material possesses an elongation value that is different than the elongation value of each of the first textile panel and the second textile panel.

20 Claims, 6 Drawing Sheets

Related U.S. Application Data continuation of application No. 16/552,941, filed on Aug. 27, 2019, now Pat. No. 11,234,470, which is a continuation of application No. 16/011,104, filed on Jun. 18, 2018, now Pat. No. 10,420,380, which is a continuation of application No. 15/597,203, filed on May 17, 2017, now Pat. No. 10,010,118, which is a continuation of application No. 14/597,051, filed on Jan. 14, 2015, now Pat. No. 9,655,389.

(60) Provisional application No. 61/926,996, filed on Jan. 14, 2014.

(56) References Cited

U.S. PATENT DOCUMENTS

| | | | | |
|---|---|---|---|---|
| 5,857,947 | A | 1/1999 | Dicker et al. | |
| 5,978,966 | A | 11/1999 | Dicker | |
| 6,332,221 | B1 | 12/2001 | Gracey | |
| 6,854,135 | B2 | 2/2005 | Jones | |
| 7,080,412 | B2 | 7/2006 | Zeiler | |
| 7,631,367 | B2 | 12/2009 | Caillibotte | |
| 7,908,670 | B2 | 3/2011 | Semba | |
| 9,009,863 | B2 | 4/2015 | Decker | |
| 9,655,389 | B2 | 5/2017 | Blakely | |
| 10,010,118 | B2 | 7/2018 | Blakely | |
| 10,420,380 | B2 | 9/2019 | Blakely | |
| 11,234,470 | B2 | 2/2022 | Blakely | |
| 11,871,806 | B2 * | 1/2024 | Blakely | A41D 31/185 |
| 2006/0230490 | A1 | 10/2006 | Okajima | |
| 2007/0271671 | A1 | 11/2007 | Okajima | |
| 2011/0302686 | A1 * | 12/2011 | Chapuis | A41D 13/0015 2/242 |
| 2012/0304359 | A1 | 12/2012 | Bybee et al. | |
| 2013/0326185 | A1 | 12/2013 | Loh | |
| 2014/0237710 | A1 | 8/2014 | Labat | |
| 2016/0183606 | A1 * | 6/2016 | Shriver | A63B 21/0552 2/69 |
| 2021/0228394 | A1 | 7/2021 | Schultz et al. | |
| 2021/0235784 | A1 * | 8/2021 | Brown | A41D 13/0005 |

FOREIGN PATENT DOCUMENTS

| | | | | |
|---|---|---|---|---|
| GB | 2619040 | A * | 11/2023 | A41B 11/08 |
| WO | 2010045242 | | 4/2010 | |
| WO | WO-2024072234 | A1 * | 4/2024 | |

* cited by examiner

ARTICLE OF APPAREL

CROSS REFERENCE TO RELATED APPLICATIONS

The present application is a continuation of U.S. application Ser. No. 17/589,305 filed on Jan. 31, 2022 and entitled "Article of Apparel," now U.S. Pat. No. 11,871,806, which is a continuation of U.S. application Ser. No. 16/552,941 filed on Aug. 27, 2019 and entitled "Article of Apparel," now U.S. Pat. No. 11,234,470 issued Feb. 1, 2022, which is a continuation of U.S. application Ser. No. 16/011,104 filed on Jun. 18, 2018, now U.S. Pat. No. 10,420,380 issued Sep. 24, 2019, which is a continuation of U.S. application Ser. No. 15/597,203 filed on May 17, 2017, now U.S. Pat. No. 10,010,118 issued Jul. 3, 2018, which is a continuation of U.S. application Ser. No. 14/597,051 filed on Jan. 14, 2015, now U.S. Pat. No. 9,655,389 issued May 23, 2017, which claims priority to provisional application No. 61/926,996, filed Jan. 14, 2014 and entitled "Garment with Grasp-Resistant Panels." The disclosure of each of the aforementioned applications is incorporated herein by reference in its entirety.

FIELD OF THE INVENTION

The present invention relates to an article of apparel and, in particular, to an athletic garment configured to prevent grasping of the garment by a non-wearer during gameplay.

BACKGROUND OF THE INVENTION

Football jerseys, in order to accommodate wearers of various sizes, are loose fitting to allow the arms and body to move freely without undue resistance from the jersey. A loose fitting jersey, however, exposes loose or hanging material that can be grabbed by an opponent during gameplay (e.g., for tackling). An athlete engaged in an athletic competition such as football or soccer seeks to minimize the opportunity for an opponent to hold onto her uniform in an effort to control the movement of the athlete. Conventional approaches included custom tailoring an ultra-tight-fitting jersey for each individual player and body type, which is time consuming and cost prohibitive.

Thus, it would be desirable to provide an article of apparel that permits wearing by multiple body types while inhibiting grasping by an opponent.

BRIEF SUMMARY OF THE INVENTION

In at least one embodiment of the disclosure, an article of apparel includes a plurality of textile panels and an elastic textile material. The plurality of textile panels includes a first textile panel and a second textile panel. The first textile panel is spaced apart from the second textile panel to define a gap between the first textile panel and the second textile panel on the article of apparel. Each of the plurality of textile panels possesses an elongation value. The elastic textile material is positioned in the gap between the first textile panel and the second textile panel. The elastic textile material possesses an elongation value that is at least ten times greater than the elongation value of each of the first textile panel and the second textile panel.

In another embodiment, an article of apparel an elastic material with a first panel and second panel coupled to the elastic material. The first panel is comprised of a first core fabric with reinforcing ribs stitched into the core fabric. The second panel is comprised of a second core fabric with reinforcing ribs stitched into the core fabric. The first panel is distinct from the second panel on the article of apparel such that a separation is defined between the first panel and the second panel with the elastic material in the separation.

In yet another embodiment, a method of forming an article of apparel is disclosed. The method includes providing an elastic textile material and joining a plurality of textile panels to the elastic textile material. The plurality of textile panels include a first textile panel and a second textile panel each comprised of a core fabric with reinforcing ribs stitched into the core fabric. The first textile panel is spaced apart from the second textile panel on the article of apparel to define a gap between the first textile panel and the second textile panel. The elastic textile material is positioned in the gap between the first textile panel and the second textile panel on the article of apparel.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1A:
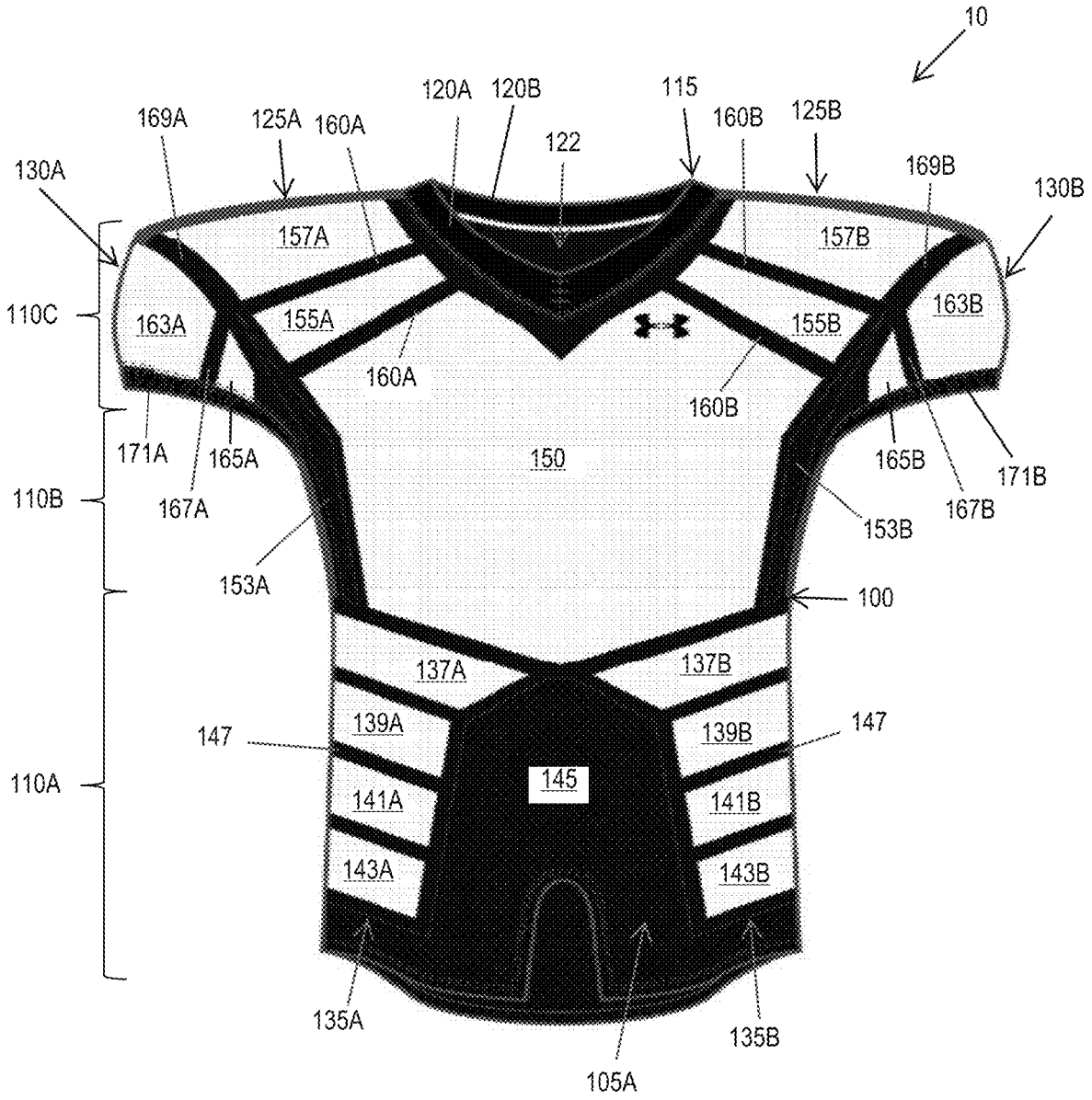
FIG. 1A is a front view in elevation of an article of apparel in accordance with an embodiment of the invention.
Figure 1B:
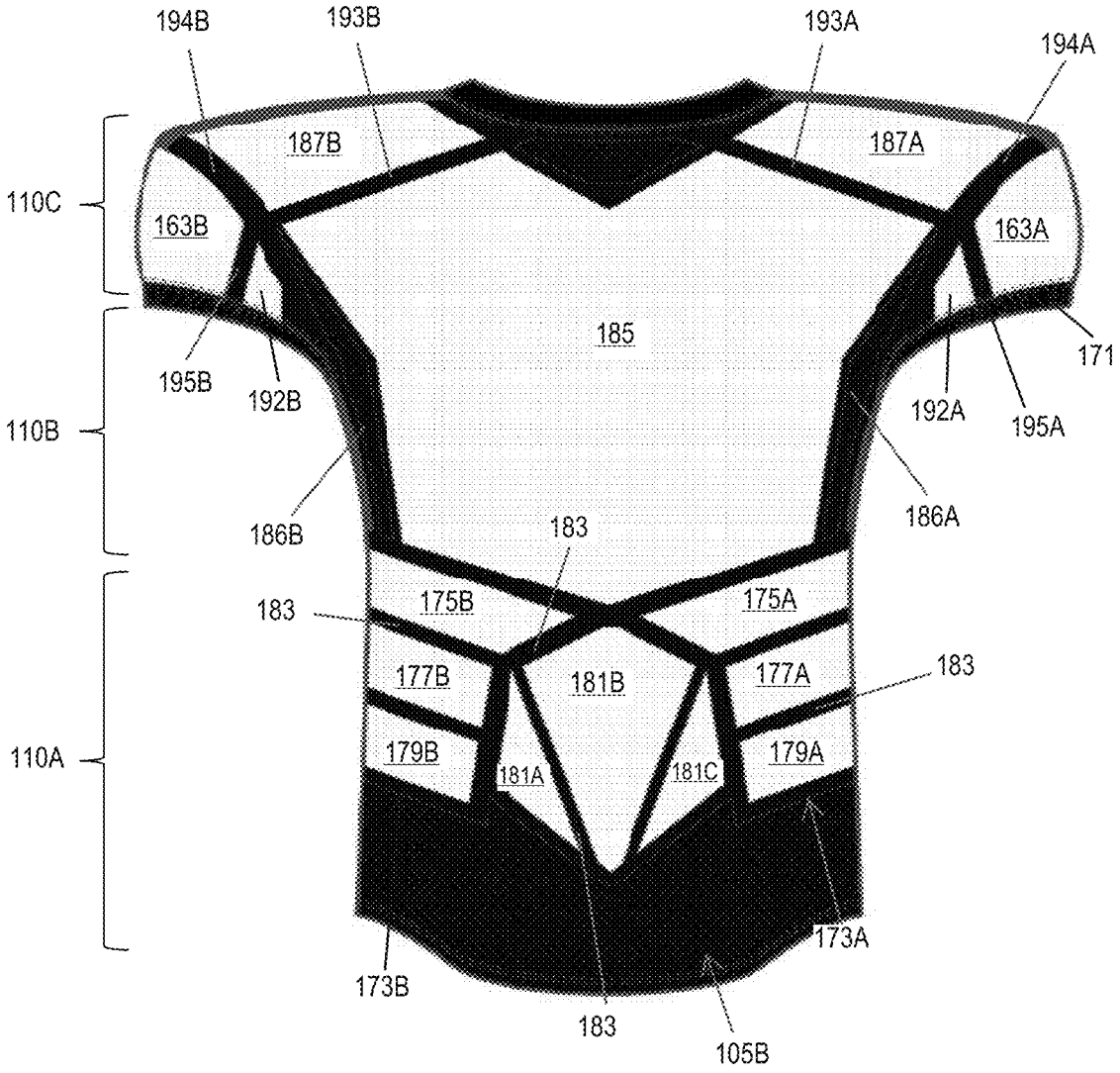
FIG. 1B is a rear view in elevation of the article of apparel shown in FIG. 1A.
Figure 1C:
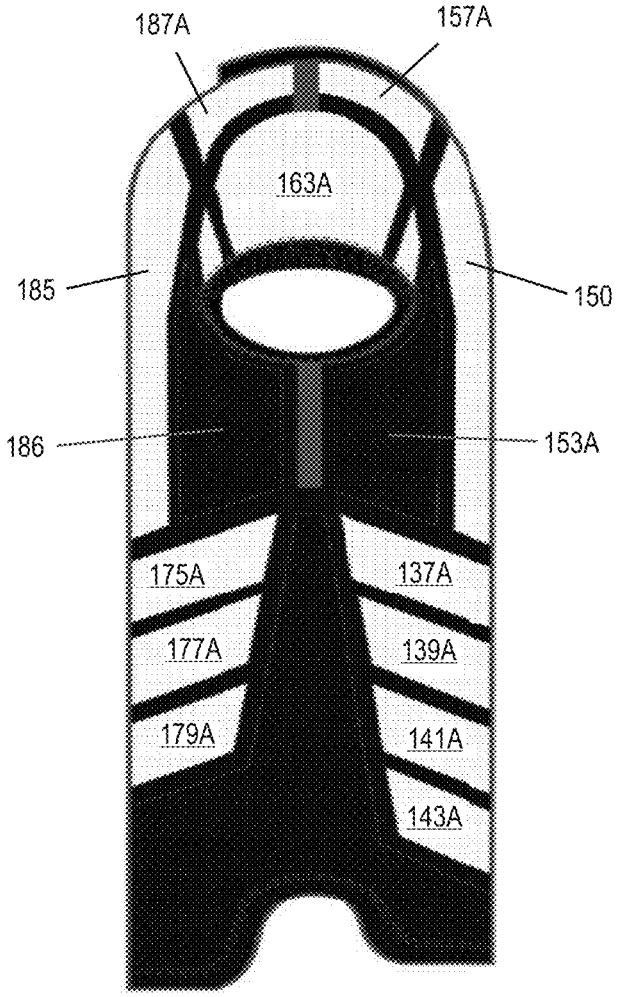
FIG. 1C is a left side view in elevation of the article of apparel in FIG. 1A

Referring to FIGS. 1A, 1B, and 1C, an article of apparel may be in the form of a garment such as a game jersey and, in particular, an American football jersey or a global soccer jersey. As shown, the article of apparel 10 includes a body 100 with a front body portion 105A that generally covers the front of the torso and a rear body portion 105B that generally covers the rear of the torso. The body 100 defines a lower or waist section 110A, an intermediate or chest/back section 110B, and an upper or shoulder section 110C. The shoulder section 110C includes a collar 115 defining a forward neckline 120A and a rearward neckline 120B. The necklines 120A, 120B cooperate to define a neck opening 122. The shoulder section 110C further includes a first or right shoulder 125A extending laterally from the collar 115 and a first or right sleeve 130A extending from the right shoulder 125A, as well as a second or left shoulder 125B extending laterally from the collar 115 and a second or left sleeve 130B extending from the left shoulder 125B.

The waist section 110A, which generally spans the waist of the wearer, includes a bottom opening 135.

Figure 2:
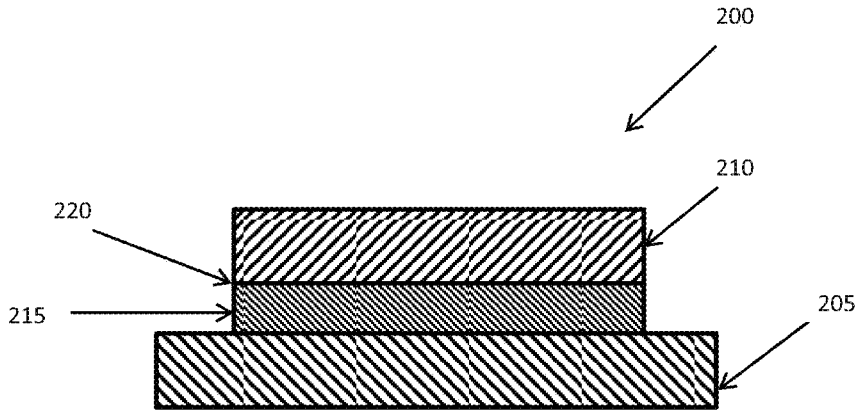
FIG. 2 is a cross sectional view of a portion of the article of apparel, showing the multilayer fabric construction.

The article of apparel 10 is formed of a multilayered textile including layers possessing differing elongation properties. Referring to FIG. 2, the multilayered textile 200 includes a first textile layer or substrate 205 coupled a second textile layer or overlay 210. Specifically, the multilayered apparel textile 200 may be a fabric laminate, with the second textile layer 210 being mounted on (fixed or attached) to the first textile layer 205 via a bonding agent or layer 215 (e.g., an adhesive film) to define a joint 220. In an embodiment, the first textile layer 205 is an inner layer (oriented closer to the user) of the fabric laminate 200 (thus the article of apparel 10), while the second textile layer 210 is an exterior layer (oriented further away from the wearer than the first layer). In another embodiment, the first textile layer 205 is the interior (innermost, user-facing) layer of the article of apparel 10, while the second textile layer 210 is the outermost layer.

The first textile layer 205 possesses a first elongation value. Elongation is the deformation in the direction of load caused by a tensile force. Elongation may be measured in units of length (e.g., millimeters, inches, etc.) or may be calculated as a percentage of the original specimen length in its relaxed (unstretched) position. Typically, elongation is measured at a specified load such as the breaking load. In an embodiment, the first textile layer is a stretch or elastic fabric. Elastic or stretch fabrics are fabrics which are able to expand under load and regain their original form when the load is removed (a property called recovery). Elastic and stretch fabrics are typically made from an elastomer (i.e., fibers, filaments or yarn including an elastomer), either alone or in combination with other (non-elastomer) fibers, filaments, or yarns. Elastomers include, but are not limited to, rubber, polybutadiene, thermoplastic polyurethane, polyester-polyurethane copolymers (spandex/elastane), a biconstituent filament (elasterell), an elastoester, lastol, and polyisoprene (elastodiene). Elastomers may be integrated as raw fibers, or may be woven, bundled, or braided into the fabric. In addition, some stretch fabrics may be formed without the use of elastomers.

Elastomeric fibers are typically used in combination with relatively inelastic fibers, such as polyester, cotton, nylon, rayon or wool (called hard fibers). In an embodiment, the proportion of elastomeric fibers in the fabric may include about 20% by weight or less (e.g., from about 1% to about 20% by weight) to provide desired stretch and recovery properties of the fabric. In another embodiment, the elastomer concentration is greater than 20%. By way of example, the first textile layer 205 includes a blend of polyester, nylon, and elastane (e.g., 40-55 wt % polyester; 30-35 wt % nylon, and 10-20 wt % elastane). In other embodiments, the elastic fabric includes FIBER J, available from Lubrizol, Inc. (MI, USA).

The elastic or stretch fabric may be a comfort stretch or power stretch fabric. Comfort stretch fabrics generate an elongation of less than 30% (e.g., about 5%-30%) under load. Stated another way, comfort stretch fabric is a term that applies to fabrics with less than 30% stretch factors. Power stretch fabrics generate an elongation of about 30%-50%. Accordingly, power stretch fabrics have a higher degree of extensibility, as well as quick recovery. Stretch factors generally range from 30% to 50% and with no more than 5% to 6% loss in recovery. In still other embodiments, the first textile layer 205 may be a fabric having or over 100% stretch factors (elongation).

The elastic or stretch fabric (i.e., the first textile layer 205) may be a mono-elastic fabric, which stretches in a single, longitudinal or horizontal direction (also called a two way stretch fabric) or bi-elastic fabric, which stretch in both longitudinal and horizontal directions (also called a four-way stretch fabric.

The first textile layer 205 is preferably a knit fabric. Knit fabrics include interlocking looped stitches, with the interlocking loops of yarn creating lengthwise ribs called wales and crosswise lines called courses. In single knits, the wales are visible from the right side of the fabric and the courses are visible on the fabric's wrong side. Knitting can further be used to provide elongation properties to the first textile layer. Knit fabrics are typically classified by their amount of stretch. Firm, stable knits have very little stretch. Moderate stretch knits are those that stretch about 25% in the crosswise direction. Interlock knits are lightweight and drapable, slightly heavier than jersey knit, and don't curl at the edge, making them easier to handle than jersey knit. Two-way stretch knits may have up to 50% and 75% stretch in the lengthwise and crosswise directions. Super stretch knits stretch 100% or more in both directions.

For improved adhesion of the first textile layer 205 to the second textile layer 210, the first layer 205 is preferably seamless and/or stitchless either in its entirety or at least along the joint 220. In an embodiment, the entire first textile layer 205 (and thus the entire body 100) is seamless and stitchless. A first layer 205 with seams (i.e., apparel including joined fabric segments connected via stitches or thermal tapes) suffers from several disadvantages. First, seams are heavy relative to the fabric segments that the seams connect. Consequently, seams add to the weight to the article of apparel 10. Second, seams define the weakest point of an article of apparel-garment failure regularly occurs along the seam. Third, seams create friction points with respect to the wearer, making the garment less comfortable. Finally, as mentioned above, seams are poor direct bonding sites, preventing proper bonding of the second layer 210 to the first layer 205 (e.g., via an adhesive).

Thus, in an embodiment, the first textile layer 205 (the body 100) is formed via a seamless warp knit process (also referred to as warp knit seamless), which is capable of forming an article of apparel 10 with multiple diameters. Seamless warp knitting is based on double needle bar raschel knitting in which a yarn is knitted across adjacent columns (wales), rather than a single row. In contrast, circular knitting knits yarn along a single row, which results in fabric that is tube-shaped, possessing a single, consistent diameter. Thus, to form a sleeved shirt via circular knitting, it is necessary to form each of the trunk, shoulders, and sleeves separately, and then connect (via sewing or thermal tape) the pieces together. In contrast, seamless warp knitting is capable of forming the trunk, the arms, and the neck of a shirt during the same knitting run (no cutting and connection required, i.e., a unitary structure is formed). Circular knit fabrics, moreover, are prone to runs when the fabric is perforated. That is, should the fabric be perforated at a point, stitches proximate the point will unravel, creating a run/tear in the fabric. Warp knitted fabrics, however, will not run. Thus, warp knitting results in fabric having increased durability and strength.

Forming the first textile layer 205 (the apparel body 100) via seamless warp knitting, then, provides several advantages over garments formed via other knitting processes (e.g., circular knitting). With stretch garments, seams define areas of lower elongation (relative to the elongation of the fabric) within a garment. That is, a piece of seamless fabric will stretch more than a similar fabric piece with one or more seams. This lower elongation not only interferes with the wearer's freedom of movement, but limits the degree of adaptability of the fabric, limiting the body types on which the fabric may fit. A seamless garment, however, provides improved freedom of movement compared to the same garment formed with seams. This higher elongation further enables a wider fit range for various body shapes. That is, a single garment measurement can be suitable for wider range of fit because of its higher elasticity. Finally, the warp knit seamless process permits body mapping, where varying structures and/or yarn types can be integrated into garments and positioned accurately to impart special properties such as moisture management, heat management and compression.

The second textile layer 210 possesses a second elongation value that is less than the first elongation value possessed by the first textile layer 205. By way of example, the second textile layer 210 is formed of non-stretch or no-stretch fabric, i.e., fabric having an elongation of about 5% or less (e.g., 0% elongation). In an embodiment, a non-stretch fabric includes yarns which have no more than 10% elongation. By way of example, the fabrics can be made from fibers including, but not limited to, polyester, polyamide, aramids, cotton, rayon, silk, polylactide-based fibers, wool, etc.

Figure 3:
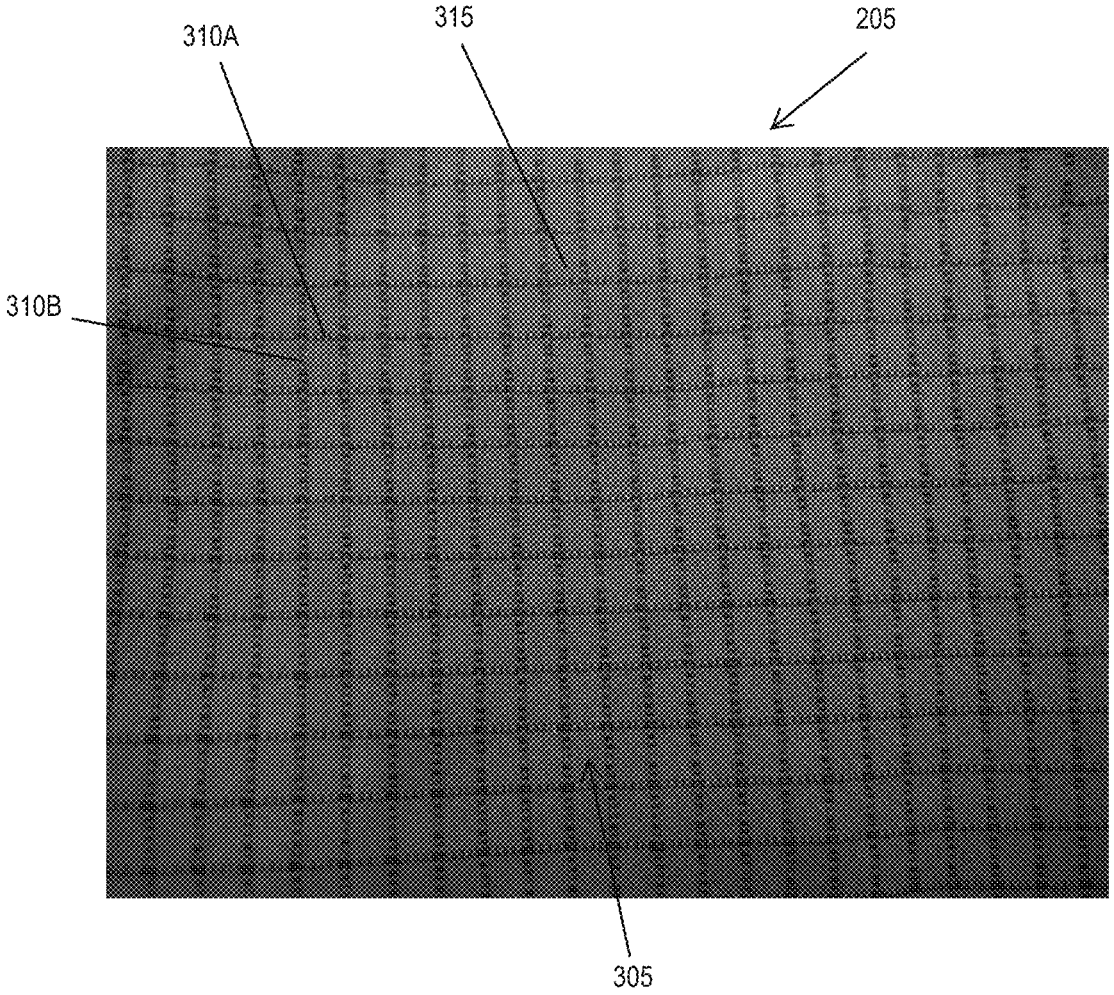
FIG. 3 is a close-up view of the second layer shown in FIG. 2, showing a non-stretch fabric.

In a preferred embodiment, the second textile layer 210 (i.e., each panel) is a woven fabric. By way of example, the second layer 210 is a non-stretch woven fabric including reinforcing ribs. Referring to FIG. 3, the second textile layer 205 includes a core fabric 305 with a plurality of vertical or longitudinal reinforcing ribs 310A and horizontal or transverse reinforcing ribs 310B. The core fabric 305 may be comprised of any material suitable for its described purpose. By way of example, the core fabric may be formed of cotton, silk, polyester, nylon, polypropylene or other synthetic materials. Preferably, the core fabric includes synthetic yarn such as nylon or polyester.

The reinforcing ribs 310A, 310B are yarns woven into the core fabric 305. In an embodiment, the yarns are non-stretchable (non-elastic) material such as high tenacity nylon (e.g., CORDURA), Nylon 6,6, or a PET fiber. As shown, each horizontal rib 310B is oriented generally orthogonal to each vertical rib 310A, and vice versa, thereby forming a plurality of cells 315 along the textile 300. While the cells 315 are square, it should be understood that the cells may possess any size and shape, and that the ribs may positioned in any manner suitable for its described purpose.

The resulting textile 300 includes reinforcing ribs 310A, 310B disposed at regular intervals and oriented in a cross-hatch pattern, which makes the textile 300 resistant to tearing. Specifically, the warp is tightly stretched lengthwise, while the weft is woven between the warp threads, forming the cells 315. In the event of a puncture, the cells 315 contain the puncture, preventing it from spreading along the length of the fabric.

The resulting fabric may possess burst strength of 200 lb/f to prevent puncturing or tearing during normal use.

With the above-described configuration, a multilayer apparel textile 200 (and thus the article of apparel 10) is provided stretch properties (e.g., overall stretch pattern) that can be tuned for a particular garment and use. The second textile layer 210, having a lower elongation than the first textile layer 205, restricts the elongation and/or movement of the first textile layer along the area of connection, i.e., along the joint 220 between the first 205 and second 210 layers (discussed in greater detail below). That is, along the joint 220, the elongation value of the first textile layer 205 is limited to the elongation value of the second textile layer 210 (e.g., less than 5% or 0%).

Referring back the FIGS. 1A-1C, the first layer 205 is generally continuous, forming the body 100 of article of apparel 10. The second layer 210 is discontinuous, being defined by a plurality of plates or panels disposed at selected locations along the exterior surface of the first textile layer. Each panel may possess any dimensions (size/shape) suitable for its described purpose (to create no stretch, non-grasp zones). The panels may be oriented so that they register with specified areas of the body, i.e., areas subject to grab during game play including, but not limited to, the chest, shoulders, back, and stomach. Referring back to FIG. 1A, the waist section 110A along the body front 105A includes a first lateral panel set 135A and a second lateral panel set 135B that cooperate to form pairs of stomach panels. Specifically, the waist section 110B includes a first panel pair 137A, 137B; a second panel pair 139A, 139B; a third panel pair 141A, 141B; and a fourth panel pair 143A, 143B disposed along the lateral sides of the wearer's stomach. Each pair is oriented in spaced relation to define not only a primary exposed area 145 or gap proximate the center of the stomach, but also secondary exposed areas 147 between the panels.

The chest section 110B of the front body portion 105A includes a single chest panel 150 spanning substantially the entire chest section, leaving lateral exposed areas or gaps 153A, 153B. Alternatively, the chest section 110B may include a plurality chest panels spaced about the chest section.

Each shoulder 125A, 125B of the shoulder section 110C includes a lower panel 155A, 155B spaced from an upper panel 157A, 157B to define exposed areas or gaps 160A, 160B within the shoulder section. Similarly, each sleeve 130A, 130B of the shoulder section 110C includes an upper panel 163A, 163B and a lower panel 165A, 165B spaced from not only each other, but also from the shoulder panels 163A, 163B, 165A, 165B to define exposed areas or gaps 167A, 167B, 169A, 169B. As shown, the shoulder sleeve panels 163A, 163B, 165A, 165B are also offset from the terminal end of each sleeve 130A, 130B to define exposed sleeve areas 171.

Referring to FIG. 1B, similar to the front body portion 105A, the waist section 110A of the rear body portion 105B includes lateral panel sets 173A, 173B defined by three pairs of lateral panels 175A, 175B, 177A, 177B, 179A, 179B; each pair being disposed on opposite lateral sides of the wearer's back. The waist section 110A further includes a plurality of central back panels 181A, 181B, 181C oriented to cover the small of the wearer's back. The panels 175A, 175B, 177A, 177B, 179A, 179B, 181A, 181B, 181C are spaced to define exposed areas or gaps 183.

The back section 110B of the rear body portion 105B includes a single panel 185 substantially covering the back to define lateral exposed areas or gaps 186A, 186B. Each shoulder 125A, 125B of the rear body portion 105B includes an associated rear shoulder panel 187A, 187B laterally spaced from sleeve panels 190A, 190B, 192A, 192B to define exposed areas 193, 194, 195 within the shoulder section 110C.

Accordingly, the second layer 210, being defined by a plurality of panels, is discontinuous. Thus, the second layer 210 does not completely cover the total surface area of the first layer 210, leaving selected areas of the first layer 205 exposed. The gap between adjacent panels may be aligned with flex points of the body (along joints, etc.) or along areas covering protective gear typically worn under game apparel (e.g., shoulder pads). As seen in the figures, a plurality of generally elongated vertical, horizontal, and angled exposed areas exist in the article of apparel 10. In these exposed (non-paneled) areas, the first layer 205 expands/stretches freely. The dimensions of the gap (in its resting (unstretched) state) may be any suitable for its described purpose. By way of example, the space between adjacent panels is less than twelve inches, e.g., less than six inches, less than four inches, or no more than two inches. Areas of greater than six inches create grab points on the garment. Spacing of less than 0.5 inches minimizes the adaptability of the apparel.

In an embodiment, the second textile layer 205 covers at least 25% of the surface area of the exterior side of the first textile layer (leaving 75% of the first textile surface area exposed). In another embodiment, the second textile layer 210 covers at least 50% of the first textile layer surface (leaving 50% exposed). In still another embodiment, the second textile layer 210 covers at least 75% of the first textile layer surface (leaving 25% exposed). In still further embodiment, the second textile layer 210 covers at least 85% of the first textile layer surface (leaving 15% exposed).

Where the exposed areas stretch freely, movement (stretching) of the first textile layer 205 is restricted (e.g., eliminated) wherever the first textile layer is connected to an associated panel of the second textile layer 210. That is, any portion of the first textile layer 205 aligned/in registry with the second textile layer 210 (i.e., aligned with a panel) will not be permitted to elongate/stretch (or will possess an elongation value equal to that of its associated second layer panel). With this configuration, the second layer panels will be able to move relative to each other (due to the resiliency of the exposed areas), but will be fixed relative to the first layer (along the joint 220). Accordingly, the multilayer apparel textile 200 expands and contracts along the exposed areas, but does not expand along the panels.

The second layer 210 may be bonded or attached (e.g., directly bonded/attached) to the first layer 205 via a bonding layer 215. The bonding layer 215 may be an adhesive such as a thermoplastic adhesive. By way of example, the bonding layer 215 includes an adhesive film having a line temperature range of 150° C. to 170° C. and/or a softening point of 115° C. and/or a melt flow index of 34 dg/min. The thickness of the film may range from about 25 μm to about 100 μm. By way of specific example, the adhesive film is polyurethane adhesive film. The adhesive film may exhibit a recovery (the percent of the shape retained after being stretched to 100% of its original length) of approximately 90%. Such films are available under the trade name SEWFREE films, and are available from Bemis Associates, Shirley, MA.

The adhesive film may further include a thermoplastic polyurethane (TPU) film. TPU films exhibit high tensile strength, flexibility, and abrasion resistance. These films can be used with a variety of manufacturing methods ranging from hot-melt to flame lamination. Many different welding operations including ultrasonic, HF, RF and platen sealing can be used to activate the films. These films are commercially available from Bemis Associates, Shirley, MA (e.g., 3412 adhesive).

The multilayer apparel textile 200 may be further processed after the bonding layer 215 is attached to the second textile layer 210. By way of example, the combined second textile layer 210 and bonding layer 215 structure may be perforated to provide breathability (increased fluid flow (air, water)) at selected locations within the garment. With this approach, the adhesive braces the hole formed into the second layer, preventing fraying of the fabric. Alternatively, perforation may occur after bonding to the first textile layer 205 to the second textile layer 210 (this, however, runs the risk of damaging the underlying first textile layer 205).

Figure 4:
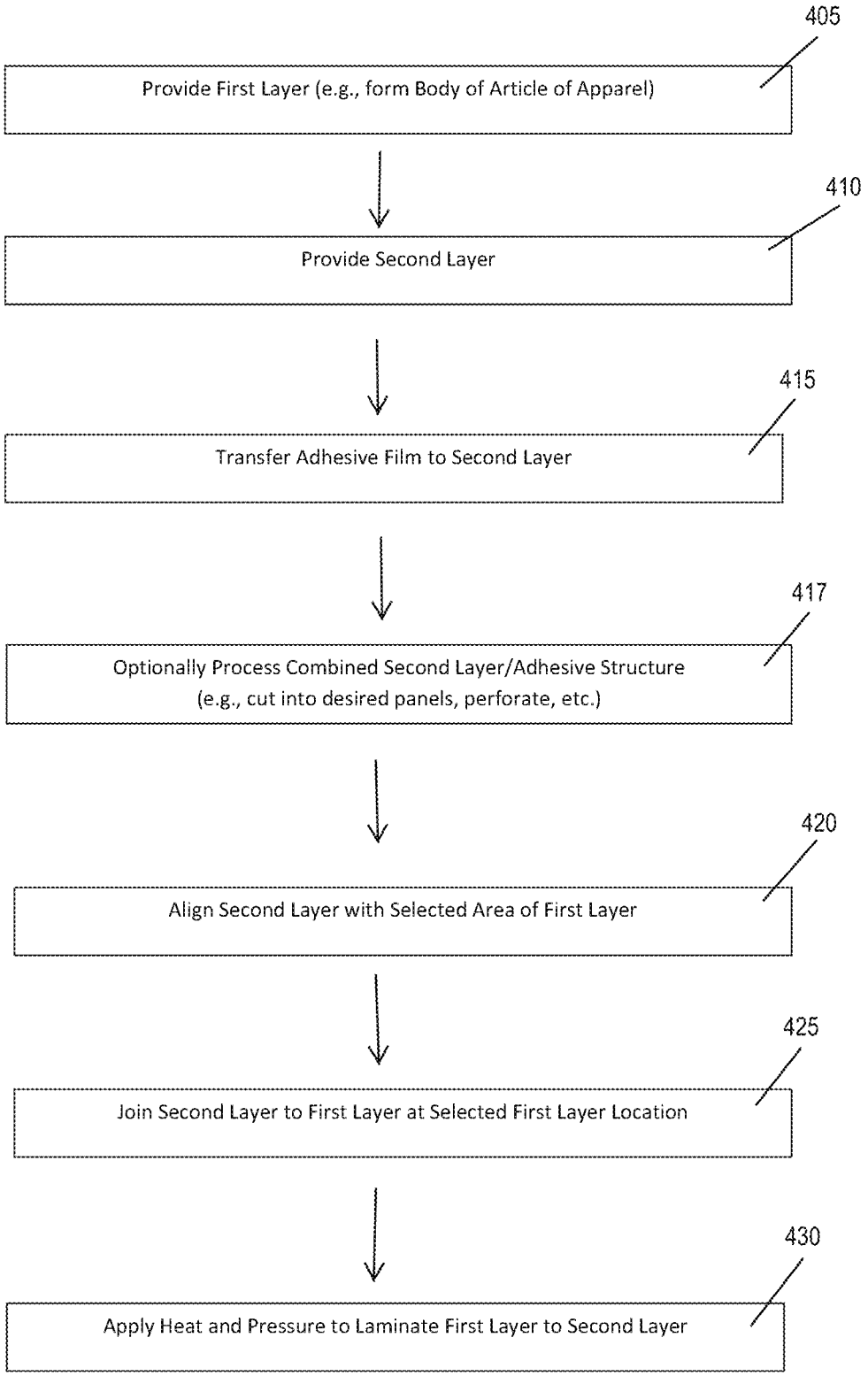
FIG. 4 is a diagram showing the process of forming the article of apparel.

The process for forming the article of apparel 10 is explained with reference to FIG. 4. Initially, the first textile layer 205 is obtained (Step 405). As noted above, the number of seams within the first layer 205 should be minimized and, if possible, eliminated. By way of example, the first layer 205 may be formed via a seamless warp knitting process utilizing a jacquard apparatus (e.g., the SWD4/2J electronic warp knitting machine, available from Santoni, Brescia, Italy). It is important to note that, when the first textile layer 205 is warp knit seamless, the entire garment defined by the first layer (jersey or pants) is formed during the same knitting run (i.e., no further processing (sewing) is required to form the first layer 205).

Next, the second textile layer 210 is provided (Step 410). As explained above, in an embodiment, the second textile layer 210 is a woven non-stretch fabric including a core fabric with a crosshatch of reinforcing yarns. The second textile layer 210 is mounted onto the first textile layer 205 in an area of the first textile layer that is seamless and stitchless. Specifically, a polyurethane adhesive film on release paper (Bemis 3412) is brought into contact with a surface of the second textile layer 210 to adhere the film to the second textile layer 210 (Step 415). As explained above, once adhered, the second textile layer 210 may be processed. Specifically, the second textile layer 210 is divided/separated into individual panels via a cutting device such as a laser cutter. The panels may be circles, polygons, etc. Additionally, if ventilation holes are desired, the second layer 210 (and the adhesive film) may be perforated via, e.g., laser perforation, mechanical punching, etc. (step 417). Processing after application of the adhesive stabilizes the second layer fabric, minimizing fraying or runs along cuts and stabilizing the areas around perforation holes.

Once processed, the second textile layer 210 may be bonded to the first textile layer 205. The release paper is removed from the second textile layer, exposing the adhesive. The exposed adhesive side of second layer panel is then brought into registry (aligned) with a selected area of the first textile layer 205 (Step 420) and is urged into contact therewith (step 425). For example, the second layer panels may be aligned with one or more areas of the waist section 110A, chest/back section 110B, and shoulder section 110C. In an embodiment, a first panel is positioned on the first textile layer and a second panel is positioned adjacent the first panel such that the panels are spaced from each other. When multiple panels are provided, adjacent panels may be spaced apart from each other.

Heat and pressure is then applied to the layers 205, 210, 215 (Step 430), thereby bonding the first textile layer 205 to the second textile layer 210. For example, when a flat press is utilized, a lamination temperature of approximately 150° C.-170° C. is applied under a pressure of approximately 40-60 psi for approximately 5 to 30 seconds. If a continuous bonding machine is utilized, a temperature of 250° C. to 300° C. at a speed of 1.5 to 2.0 m/min under pressure of 1 Bar (14.3 psi) is effective.

If warp knit seamless was utilized to form the first textile layer 205, the article of apparel is formed upon bonding the desired second textile layer panels thereto. If, however, other methods were used to form the first textile layer 205, it is possible to shape the first textile layer fabric into the article of apparel (e.g., via sewing pieces together or other conventional methods) bonding of the second textile layer 210 thereto. Alternatively, the apparel textile 200 may be shaped into apparel after formation.

The resulting article of apparel 10 or garment possesses several functional advantages over conventional sporting garments. The exposed areas enable the overall expansion of the garment when a force is applied. That is, each exposed areas expand from its normal position, permitting the garment to expand to accommodate placement on the body, as well as to accommodate and protective equipment such as shoulder pads. Additionally, each exposed area may expand/ stretch to varying degrees to accommodate varying body types and types of protective equipment.

Once on body, however, the garment 10 constricts, becoming snug against the user since the elastic/compression fabric is biased toward its normal position (i.e., toward the user). Consequently, the garment eliminates loose hanging fabric that could be grabbed by a competitor during game player. The areas of the article of apparel 10 including second layer panels do not stretch; moreover, the panels of the second textile layer 210 possess a low coefficient of friction (relative to the first textile layer). Consequently, it is difficult for a competitor to grasp the article of apparel 10 along a panel. That is, it will be difficult for a competitor to grasp a handful of fabric. Instead, the competitor's hands will slide off.

The above invention provides an article of apparel that, while inhibiting grasping by a competitor, will permit full range of motion during use. The skin of the body may expand as much as 50% during movement (elbow, knee, etc.). Consequently, elastic fabric is advantageous to accommodate for motion. The fabric laminate of the present invention retains its elastic properties at critical movement points along the body, permitting a user to participate in the natural, full range of motion, which is beneficial in athletic activities. This is in contrast to jerseys formed solely of non-stretch material, which interfered with athlete movement, making it difficult too, e.g., run, pass, catch, and/or block.

While the invention has been described in detail and with reference to specific embodiments thereof, it will be apparent to one skilled in the art that various changes and modifications can be made therein without departing from the spirit and scope thereof. For example, the first textile layer 205 may be engineered with vary degrees of stretch. By way of example, the arm sleeves of a shirt may possess an elongation of 50%, while the trunk of shirt may possess an elongation of less than 30%.

The second textile layer 210 may be formed of fabric having a low stretch (e.g., less than about 40% stretch, less than about 25% stretch, less than about 10% stretch, less than about 5% stretch, or less than about 3% stretch) or no stretch (approximately 0% stretch). The panels forming the second textile layer 210 may all be formed of the same or may be formed different materials. Additionally, the panels forming the second textile layer 210 may each possess the same stretch percentage, or may possess different stretch percentages. For example, the chest panel may be formed of non-stretch material (material possessing a 0% stretch), while the shoulder panels may be formed of material possess low stretch (e.g., less than about 2% stretch).

Each panel may possess any dimensions (size/shape) suitable for its described purpose. By way of example, the panels may be polygons or circles. The panels, moreover, may be arranged in any pattern or collection of panels.

The cells 315 of the second textile layer 210 may be any shape suitable for their described purpose. By way of example the cells may be polygonal, e.g., possessing a generally square shape.

The amount of first textile layer surface area left covered and/or exposed may be any suitable for its described purpose. Generally, the higher the elasticity of the first layer 205, the greater the amount of surface area that may be covered. The second layer may be provided in the form of individual panels to which the adhesive is applied, or may be provided as a single sheet that is cut into panels after application of the adhesive.

The first textile layer 205 may possess distinct and continuous elasticity. The percent elongation of the first layer may include, but is not limited to, greater than about 50% stretch/growth/expansion, greater than about 60% stretch/growth/expansion, greater than about 70% stretch/growth/expansion; greater than about 80% stretch/growth/expansion, greater than 90% stretch/growth/expansion, greater than about 100% stretch/growth/expansion, and greater than about 125% stretch/growth/expansion (all from a normal (unstressed) position).

In an embodiment, the first textile layer 205 possesses an elongation of about 5% or more (e.g., more than 5%) and the second textile layer 210 possesses an elongation of about 5% or less (e.g., less than 5%). In another embodiment, the first textile layer possesses an elongation of about 100% or more (e.g., at least 100%), while the second textile layer possesses an elongation of about 0% (e.g., 0%).

The article of apparel 10 includes competitive sporting apparel such as jerseys (football jerseys, soccer jerseys, rugby jerseys basketball jerseys, etc.), shirts, tank tops, shorts, and pants.

Thus, it is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed is:

1. An article of apparel comprising:

a plurality of textile panels including a first textile panel and a second textile panel, the first textile panel spaced apart from the second textile panel to define a gap between the first textile panel and the second textile panel on the article of apparel, wherein each of the plurality of textile panels possesses an elongation value; and an elastic textile material positioned in the gap between the first textile panel and the second textile panel on the article of apparel, the elastic textile material possessing an elongation value that is at least ten times greater than the elongation value of each of the first textile panel and the second textile panel.

2. The article of apparel of claim 1 wherein the elastic textile material defines a first layer on the article of apparel and the plurality of textile panels define a second layer on the article of apparel.

3. The article of apparel of claim 2 further comprising a bonding layer positioned between the first layer and the second layer.

4. The article of apparel of claim 2 wherein the first layer is an inner layer and the second layer is an outer layer on the article of apparel.

5. The article of apparel of claim 4 wherein the second layer covers at least 50% of an exterior surface area of the first layer.

6. The article of apparel of claim 1 further comprising a plurality of reinforcing ribs on the plurality of textile panels.

7. The article of apparel of claim 6 wherein each of the plurality of textile panels are comprised of a core fabric with the plurality of reinforcing ribs stitched into the core fabric.

8. The article of apparel of claim 7 wherein the plurality of reinforcing ribs are comprised of non-elastic yarns woven into the core fabric.

9. The article of apparel of claim 1 wherein the elastic textile material is a knit fabric and each of the plurality of textile panels is a woven fabric.

10. A uniform configured to be worn by an athlete, the uniform comprising:

protective equipment configured to be supported by the athlete; and a garment covering the protective equipment, the garment comprising:

a plurality of textile panels including at least a first textile panel and a second textile panel, the first textile panel spaced apart from the second textile panel to define an elongated gap between the first textile panel and the second textile panel on the garment, the elongated gap covering an area of the protective equipment; and an elastic textile material positioned in the gap between the first textile panel and the second textile panel on the garment, the elastic textile material possessing an elongation value that is greater than an elongation value of each of the plurality of textile panels.

11. The uniform of claim 10 wherein the elongated gap is further aligned with flex points on the protective equipment.

12. The uniform of claim 10 the elongated gap having a width dimension defining a distance between the first textile panel and the second textile panel, wherein the width is less than six inches.

13. The uniform of claim 12 wherein the width is at least half an inch.

14. The uniform of claim 13 wherein the width is no more than two inches.

15. The uniform of claim 10 wherein the elastic textile material defines a first layer on the garment and the first and second panels define a second layer on the garment.

16. The uniform of claim 15 wherein the first layer is an inner layer and the second layer is an outer layer on the garment.

17. The uniform of claim 10 wherein the first textile panel possesses a different elongation value than the second textile panel.

18. A method of forming an article of apparel, the method comprising:

providing an elastic textile material defining an elongation value; and joining a plurality of textile panels to the elastic textile material, the plurality of textile panels including a first textile panel and a second textile panel each comprised of a core fabric, the first textile panel spaced apart from the second textile panel on the article of apparel to define a gap between the first textile panel and the second textile panel, wherein the elastic textile material is positioned in the gap between the first textile panel to the second textile panel on the article of apparel, and wherein each of the plurality of textile panels include an elongation value that is less the elongation value of the elastic textile material.

19. The method of claim 18 further comprising, prior to joining the plurality of textile panels to the elastic textile material, transferring an adhesive the plurality of textile panels and aligning the plurality of textile panels with selected areas of the elastic textile material.

20. The method of claim 19 further comprising, after joining the plurality of textile panels to the elastic textile material, applying heat and pressure to the article of apparel in order to laminate the plurality of textile panels to the elastic textile material.

* * * * *